US006609713B1

(12) United States Patent
Heffron et al.

(10) Patent No.: US 6,609,713 B1
(45) Date of Patent: Aug. 26, 2003

(54) SCAVENGER HUNT-TYPE CARD-BASED GAME INCORPORATING PERSONALITY TRAIT, COMMAND AND/OR EVENT CARDS AND METHOD FOR PLAYING SAME

(75) Inventors: John R. Heffron, Whitmore Lake, MI (US); Joel C. Zimmer, Los Angeles, CA (US)

(73) Assignee: Eleven Eleven Productions, LLC, Los Angeles, CA (US)

( * ) Notice: Subject to any disclaimer, the term of this patent is extended or adjusted under 35 U.S.C. 154(b) by 0 days.

(21) Appl. No.: 09/558,960

(22) Filed: Apr. 25, 2000

(51) Int. Cl.[7] ..... A63F 1/00
(52) U.S. Cl. ..... 273/292; 273/429
(58) Field of Search ..... 273/273, 429, 273/430, 431, 432, 440, 459, 161, 292, 308, 129

(56) References Cited

U.S. PATENT DOCUMENTS 3,484,105 A * 12/1969 Winston
4,583,737 A 4/1986 Falcone et al.
5,197,884 A * 3/1993 Roemer, Jr. et al.
5,375,846 A 12/1994 Smith
5,599,020 A * 2/1997 Fields ..... 273/161
5,741,137 A * 4/1998 Aduvala
5,772,212 A * 6/1998 Hagedorn
5,951,297 A * 9/1999 Schwartz
6,234,803 B1 * 5/2001 Watkins
6,273,425 B1 * 8/2001 Westfall et al.
6,290,230 B1 * 9/2001 Anthony
6,322,077 B1 * 11/2001 Braunlich et al. ..... 273/292
6,338,486 B1 * 1/2002 Hutchens

OTHER PUBLICATIONS

Web page entitled "How We Designed a Scavenger Hunt Part" at wysiwyg://112/http://home.earthlink.net~kromjp/scvngr1.html, 2 pages and Keith & Mary's Scavenger Hunt/Korean BBQ Saturday, Oct. 26, 1996 at http://homepage.mac.com/kromjp/shp.html, 2 pages.*

* cited by examiner

*Primary Examiner*—William M. Pierce
(74) *Attorney, Agent, or Firm*—McGarry Bair PC

(57) ABSTRACT

A card deck comprising a plurality of cards of at least one type is provided as well as a method for playing a scavenger hunt game in a selected environment/population. The plurality of cards comprises at least one type of card bearing indicia representative of a goal/target normally occurring in the selected environment/population. Players are thereby dealt a predetermined number of cards and sent into the selected environment/population and must match the goal/target on each of their cards with targets normally occurring in the selected environment/population.

14 Claims, 7 Drawing Sheets

SCAVENGER HUNT-TYPE CARD-BASED GAME INCORPORATING PERSONALITY TRAIT, COMMAND AND/OR EVENT CARDS AND METHOD FOR PLAYING SAME

BACKGROUND OF THE INVENTION

1. Field of the Invention

The invention relates generally to games and gaming card decks, and more particularly, to a scavenger hunt-type card deck incorporating various types of goal/target-related cards such as personality trait, command and/or event cards. In another aspect, the invention relates to a method for playing a scavenger hunt-type game incorporating a card deck having various types of cards.

2. Description of the Related Art

Target-based search competitions, commonly referred to as "scavenger hunts", have been long known in the game-playing field. Single players or teams of players are provided with a list of goals or targets in a first environment, sent into a second environment and must return to the first environment after searching out and locating each goal/target on their list. Typically, the player/team that first returns to the first environment wins the scavenger hunt.

However, these types of games are difficult to administer and require a great deal of time and effort to set up. First, the list of goals/targets provided to the players/teams must be recreated for each scavenger hunt and must typically be customized for the particular environment in which the players hunt for the goals/targets. Second, the administrator of the scavenger hunt typically cannot participate in the scavenger hunt since at least the administrator must know the location of some of the goals/targets on the list. Third, various environments have particular characteristics such as people having certain stereotypical characteristics or personality traits or certain events which tend to occur in that environment. It can be difficult to assemble and predict these events on a repeating basis for an administrator of a scavenger hunt to create a competitive and enjoyable competition.

SUMMARY OF THE INVENTION

The invention comprises a scavenger hunt-type card game incorporating personality trait, command and/or event cards and method for playing the same.

In one aspect, the invention relates to a method for playing a scavenger hunt-type game comprising the steps of: preselecting a social environment having a population of members with personality characteristics distinctive to the social environment; providing a plurality of targets, wherein the plurality of targets are provided on a plurality of cards, wherein the plurality of cards comprises at least one of: a first type of card having indicia representing a personality stereotype of a person conforming to at least one of the personality characteristics distinctive to the preselected social environment; a second type of card having indicia representing a command to be performed by one of the members of the population located in the preselected social environment, the command being related to the preselected social environment; and a third type of card having indicia representing a stereotypical event expected to occur with at least one member of the population in the preselected social environment, the event being related to the preselected social environment. Players are assigned a number of the plurality of targets to each player of the game; and must match each of the assigned number of the plurality of targets with: a first match type comprising a member of the population in the preselected social environment having at least one of the distinctive characteristics conforming to indicia on a card of the first type assigned to the player; a second match type comprising an act performed at the request of a player conforming to indicia on a card of the second type assigned to the player; and a third match type comprising an event witnessed by a player conforming to indicia on a card of the third type assigned to the player.

In another aspect, the invention relates to a scavenger hunt game comprising a set of targets identified at the outset of the scavenger hunt game and a set of players of the game, whereby the players set out to retrieve a set of the targets assigned to them and whereby a winner is declared as one of the set of players who retrieves each of the set of targets assigned to them. An improvement in the method of playing the scavenger hunt game comprises: providing an instruction limiting play to a preselected social environment having a population of members with personality characteristics distinctive to the preselected social environment, and a deck of cards comprising at least one of: a first type of card having indicia representing a personality stereotype of a person conforming to at least one of the personality characteristics distinctive to the preselected social environment; a second type of card having indicia representing a command to be performed by one of the members of the population located in the preselected social environment, the command being related to the preselected social environment; and a third type of card having indicia representing a stereotypical event expected to occur with at least one member of the population in the preselected social environment, the event being related to the preselected social environment. The players attempt to match the targets contained on cards dealt to them with: a first match type comprising a member of the population in the preselected social environment having at least one of the distinctive characteristics conforming to indicia on a card of the first type assigned to the player; a second match type comprising an act performed at the request of a player conforming to indicia on a card of the second type assigned to the player; and a third match type comprising an event witnessed by a player conforming to indicia on a card of the third type assigned to the player.

Various additional embodiments of the invention are also contemplated according to the invention. The method can further comprise the step of verifying that a player has performed the matching step prior to other players of the game. A player can be declared a winner who is determined to have passed the verifying step prior to other players of the game.

The plurality of cards can comprise cards of the first type and of the second type and the matching step must be matched against the first match type and the second match type. The plurality of cards can comprise cards of the first type and of the third type and the matching step must be matched against the first match type and the third match type. The plurality of cards can comprise cards of the first, second and third types and the matching step must be matched against the first, second and third match types.

The preselected social environment can be a nightclub and the first, second and third types of cards and the first, second and third match types conform respectively to personality characteristics, acts and events distinctive to a nightclub.

DESCRIPTION OF THE PREFERRED EMBODIMENT

Figure 1:
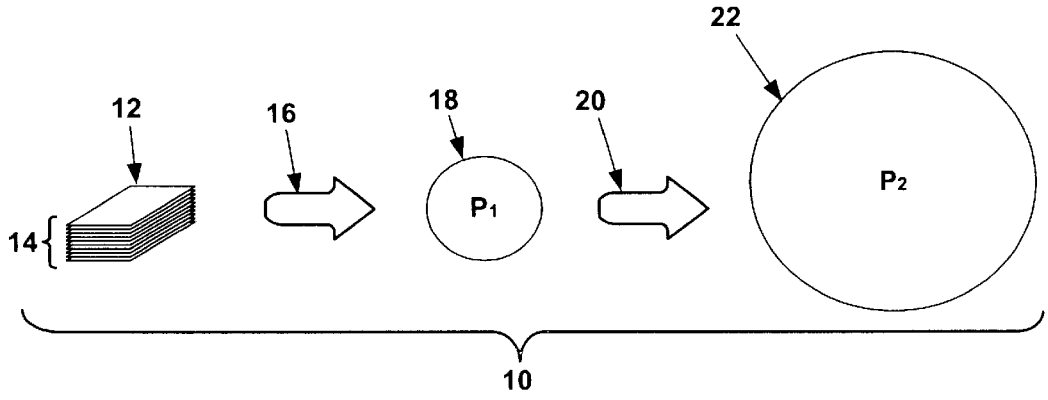
FIG. 1 is a schematic drawing showing the concept for playing the game according to the invention wherein a number of cards are dealt from a card deck to members of a first population whom thereafter enter a second population/environment to play the game.

Turning to the drawings and to FIG. 1 in particular, a scavenger hunt game 10 according to the invention is shown in schematic form. The game 10 employs a card deck 12 wherein subsets of a predetermined number of cards 14 of the card deck 12 are distributed (shown by example by arrow 16) to members of a first population $P_1$ shown by reference numeral 18. Each of the cards 14 of the card deck 12 is provided with indicia representing a goal or target of the scavenger hunt of the game 10.

Each member of the first population $P_1$ enter (shown schematically by arrow 20) a second population or environment $P_2$ shown by reference numeral 22. The goal of the game 10 is to return from the second population/environment $P_2$ after locating each of the goals/targets on a player's subset of cards 14 before the other players. Of course, the rules of the game 10 can include a verification step wherein a player must verify to an administrator of the game 10 or to the other players that each of the targets/goals were located.

The game 10 contemplates at least three types of cards 14 to be included in the card deck 12. Each of the at least three types can be included—or a reduced-type set comprising one or more of the first, second and third types of cards, i.e., the card deck 12 need only contain at least one of the types of cards.

Figures 2A, 2B, 2C:
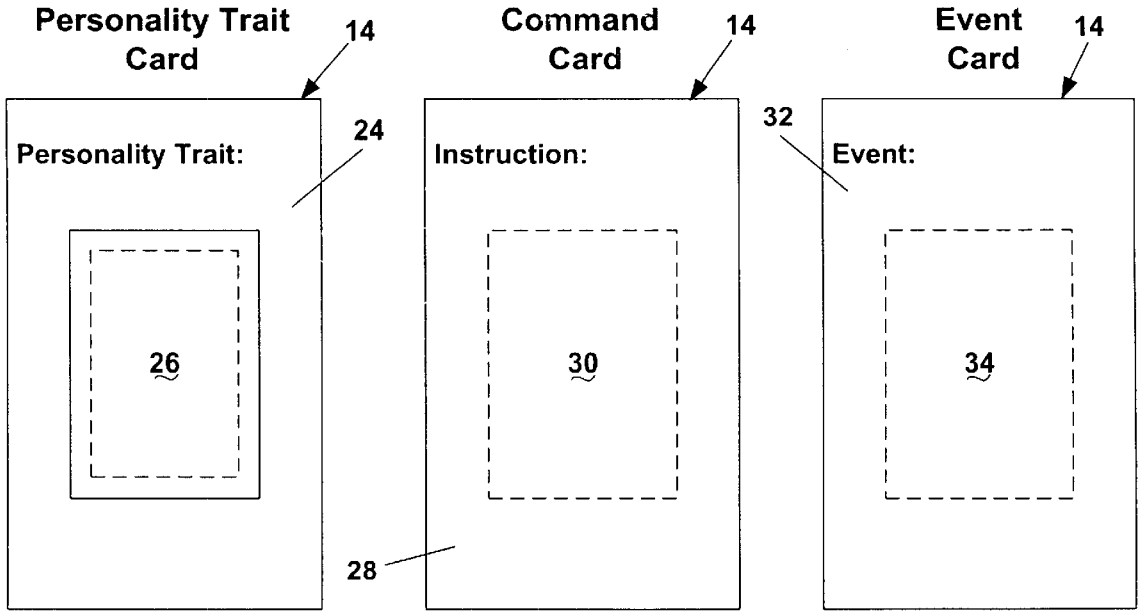
FIG. 2A is a schematic example of an operational side of a first type of card optionally contained in the card deck of FIG. 1 wherein the first type of card contains indicia representing a personality trait or stereotype.
FIG. 2B is a schematic example of an operational side of a second type of card optionally contained in the card deck of FIG. 1 wherein the second type of card contains indicia representing a command intended to be performed by a member of the second population/environment.
FIG. 2C schematic example of an operational side of a third type of card optionally contained in the card deck of FIG. 1 wherein the third type of card contains indicia representing an event intended to be witnessed in the second population/environment.

FIG. 2A shows an operational side of a first type 24 of a card 14 contained in the card deck 12 wherein the first type 24 of the cards 14 contains first indicia 26 representing a goal/target comprising a human personality trait or stereotype. A player must identify a member of the second population/environment 22 ($P_2$) who has the characteristics embodying the personality trait or stereotype to satisfy the goal/target of the first type 28 of card 14.

FIG. 2B shows an operational side of a second type 28 of a card 14 contained in the card deck 12 wherein the second type 28 of the cards 14 contains second indicia 30 representing a goal/target of a command to be performed. The player must convince a member of the second population/environment 22 ($P_2$) to perform the command to satisfy the goal/target of the second type 28 of card 14.

FIG. 2C shows an operational side of a third type 32 of a card 14 contained in the card deck 12 wherein the third type 32 of the cards 14 contains third indicia 34 representing a goal/target of an event typically occurring in the second population/environment 22 ($P_2$). The player must witness the event in the second population/environment 22 ($P_2$) to satisfy the goal/target of the third type 32 of card 14. The indicia can be of any known form, including text, graphic art work, Braille, etc.

Figure 3:
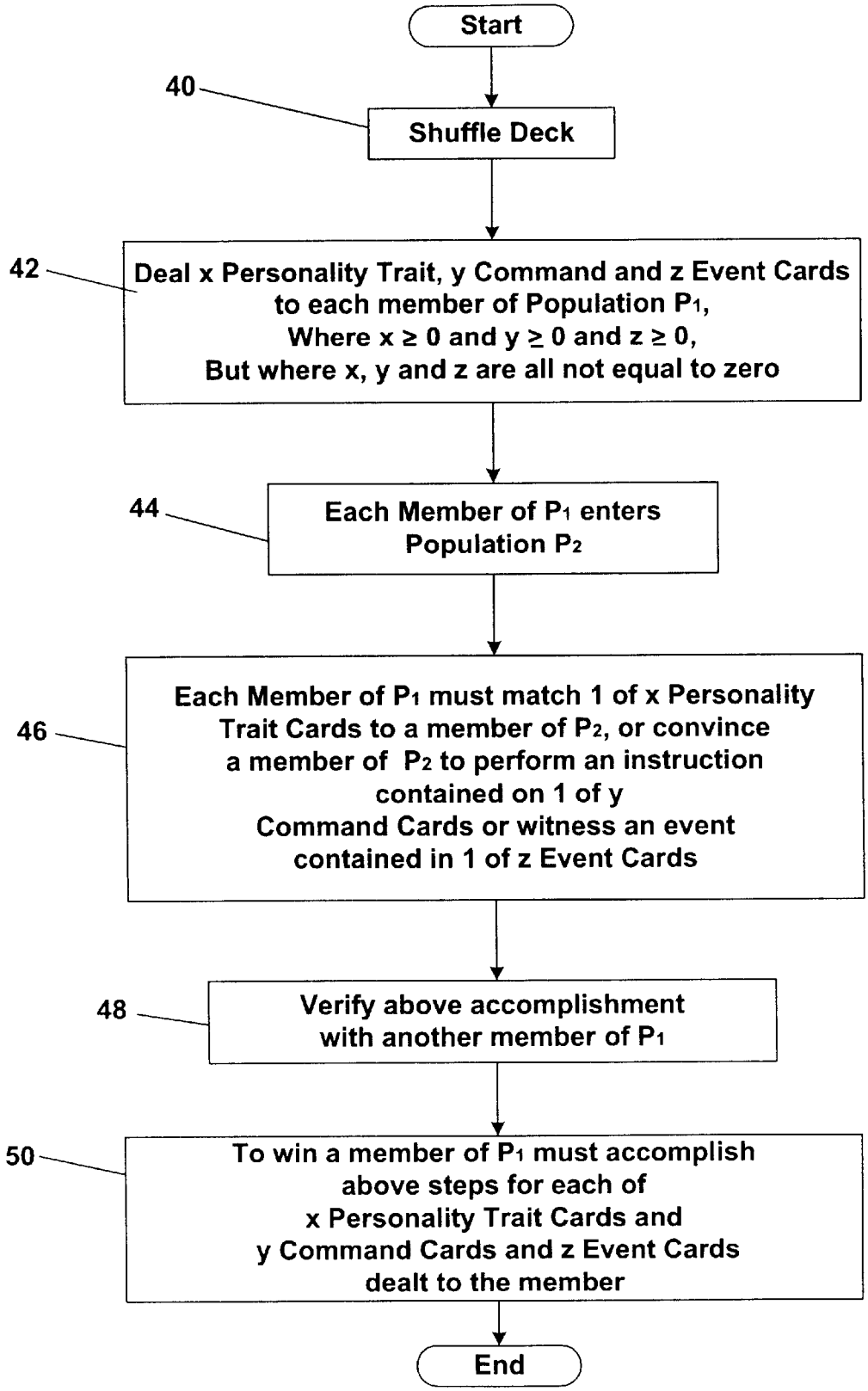
FIG. 3 is a general flow chart outlining general instructions and process steps for playing the game of FIG. 1 according to the invention.

FIG. 3 is a general flow chart outlining general instructions and process steps for playing the game of FIG. 1 according to the invention. In a first step 40, the deck 12 of cards 14 containing at least one of the first, second and third types 24, 28 and 32, respectively, are randomly ordered, preferably by shuffling. For the purposes of this description of the play of the game 10, the deck 12 of cards 14 is deemed to have x first types 24 of cards 14, y second types 28 of cards 14, and z third types 32 of cards 14. The numbers x, y and z of numbers of first, second and third types 24, 28 and 32, respectively, can be zero although, preferably, one of the types 24, 28 and 32 of cards 14 must be greater than zero. Also, the total number of cards 14 (i.e., x+y+z) is preferably sufficient to provide the players of the game 10 with a sufficient number of cards 14 to make for a fun and competitive game.

Once the deck 12 is shuffled <40>, each of the players are provided with a predetermined number of cards <42>, which can vary depending upon the length and complexity of the game desired as well as upon the number of players. Obviously, with a higher number of players, fewer cards can be provided from a finite number of cards 14. However, the length of the game can be extended as well as increasing the complexity of the game by providing the players with the highest number of cards.

Each of the players (first population $P_1$ shown by reference numeral 18 in FIG. 1) then enters the second population/environment $P_2$ (shown by reference numeral 22 in FIG. 1) <44>. To satisfy the goal/target on each of the player's cards, the player must achieve the goal/target on the card 14 in the second population/environment $P_2$ as described above with respect to the specific types 24, 28 and 32 of cards 14 in the deck 12 <46>. Once a player has claimed to have satisfied all of the goals/targets on the player's particular subset of cards 14, an administrator or other players in the game 10 may require that the player claiming victory verify the existence or description of the accomplished goals/targets as identified on the cards 14 <48>, <50>.

It should be noted that the deck 12 can comprise multiple decks 12 each containing an identical assortment of cards 14 or a single deck 12 containing an assortment of cards 14. In this manner, players can be either provided with the same or different set of cards depending upon the parameters desired for the game 10 without departing from the scope of this invention.

It is contemplated that the card deck 12 for the game 10 can be configured for multiple types of the second population/environment $P_2$.

A first example of a configuration for the card deck 12 could be for a bar/nightclub atmosphere wherein the first, second and third types 24, 28 and 32 of cards 14 are specially configured for the bar/nightclub atmosphere. The first type 24 of cards 14, namely, the personality trait cards, could be configured with indicia representing various bar/ nightclub stereotypes such as a wildly dancing person, a person spilling drinks, an overly amorous person, etc. The second type 28 of cards 14, namely, the command cards, could be configured with indicia representing various bar/nightclub requests such as requesting a drink from a person, requesting a dance from a person, etc. The third type 32 of cards 14, namely, the event cards, could be configured with indicia representing typical bar/nightclub events such as a witnessing a spilled drink, witnessing a pick-up line, etc.

A second example of a configuration for the card deck 12 could be for children traveling such as by automobile to entertain them for an extended period. The first, second and third types 24, 28 and 32 of cards 14 could be configured for entertaining children. The first type 24 of cards 14, namely, the personality trait cards, could be configured with indicia representing characteristics of people encountered while travelling such as an overly cautious driver, a speeder, etc. The second type 28 of cards 14, namely, the command cards, could be configured with indicia representing various requests made while traveling such as requesting a rest stop, requesting a fast food break, requesting quiet (typically made by any parents in the vehicle), etc. The third type 32 of cards 14, namely, the event cards, could be configured with indicia representing typical events encountered while travelling such as a witnessing one car cut off another, witnessing another vehicle exceeding the speed limit, witnessing a disabled vehicle or vehicles of a particular make or model, etc.

It will be understood that other configurations for the card deck 12 can be provided without departing from the scope of the appended claims.

While the invention has been specifically described in connection with certain specific embodiments thereof, it is to be understood that this is by way of illustration and not of limitation, and the scope of the appended claims should be construed as broadly as the prior art will permit.

What is claimed is:

1. A method for playing a scavenger hunt-type game comprising the steps of:

preselecting a social environment having a population of members with personality characteristics distinctive to the social environment;

providing a plurality of targets, wherein the plurality of targets are provided on a plurality of cards, wherein the plurality of cards comprises at least one of:

a first type of card having indicia representing a personality stereotype of a person conforming to at least one of the personality characteristics distinctive to the preselected social environment;

a second type of card having indicia representing a command to be performed by one of the members of the population located in the preselected social environment, the command being related to the preselected social environment; and a third type of card having indicia representing a stereotypical event expected to occur with at least one member of the population in the preselected social environment, the event being related to the preselected social environment;

assigning a number of the plurality of targets to each player of the game; and matching, by the players of the game, of each of the assigned number of the plurality of targets with:

a first match type comprising a member of the population in the preselected social environment having at least one of the distinctive characteristics conforming to indicia on a card of the first type assigned to the player;

a second match type comprising an act performed at the request of a player conforming to indicia on a card of the second type assigned to the player; and a third match type comprising an event witnessed by a player conforming to indicia on a card of the third type assigned to the player.

2. The method of claim 1 and further comprising the step of verifying that a player has performed the matching step prior to other players of the game.

3. The method of claim 2 and further comprising the step of declaring the player a winner who is determined to have passed the verifying step prior to other players of the game.

4. The method of claim 3 wherein the plurality of cards comprises cards of the first type and of the second type and the matching step must be matched against the first match type and the second match type.

5. The method of claim 3 wherein the plurality of cards comprises cards of the first type and of the third type and the matching step must be matched against the first match type and the third match type.

6. The method of claim 3 wherein the plurality of cards comprises cards of the first, second and third types and the matching step must be matched against the first, second and third match types.

7. The method of claim 1 wherein the preselected social environment is a nightclub and the first, second and third types of cards and the first, second and third match types conform respectively to personality characteristics, acts and events distinctive to a nightclub.

8. In a scavenger hunt game comprising a set of targets identified at the outset of the scavenger hunt game and a set of players of the game, whereby the players set out to retrieve a set of the targets assigned to them and whereby a winner is declared as one of the set of players who retrieves each of the set of targets assigned to them, the improvement in the method of playing the scavenger hunt game comprising:

providing an instruction limiting play to a preselected social environment having a population of members with personality characteristics distinctive to the preselected social environment, and a deck of cards comprising at least one of:

a first type of card having indicia representing a personality stereotype of a person conforming to at least one of the personality characteristics distinctive to the preselected social environment;

a second type of card having indicia representing a command to be performed by one of the members of the population located in the preselected social environment, the command being related to the preselected social environment; and a third type of card having indicia representing a stereotypical event expected to occur with at least one member of the population in the preselected social environment, the event being related to the preselected social environment; and wherein the players attempt to match the targets contained on cards dealt to them with:

a first match type comprising a member of the population in the preselected social environment having at least one of the distinctive characteristics conforming to indicia on a card of the first type assigned to the player;

a second match type comprising an act performed at the request of a player conforming to indicia on a card of the second type assigned to the player; and a third match type comprising an event witnessed by a player conforming to indicia on a card of the third type assigned to the player.

9. The scavenger hunt game of claim 8 and further comprising the step of verifying that a player has performed the matching step prior to other players of the game.

10. The scavenger hunt game of claim 9 and further comprising the step of declaring the player a winner who is determined to have passed the verifying step prior to other players of the game.

11. The scavenger hunt game of claim 10 wherein the plurality of cards comprises cards of the first type and of the second type and the players must match against the first match type and the second match type.

12. The scavenger hunt game of claim 10 wherein the plurality of cards comprises cards of the first type and of the third type and the players must match against the first match type and the third match type.

13. The scavenger hunt game of claim 10 wherein the plurality of cards comprises cards of the first, second and third types and the players must match against the first, second and third match types.

14. The scavenger hunt game of claim 8 wherein the preselected social environment is a nightclub and the first, second and third types of cards and the first, second and third match types conform respectively to personality characteristics, acts and events distinctive to a nightclub.

* * * * *

UNITED STATES PATENT AND TRADEMARK OFFICE

CERTIFICATE OF CORRECTION

Figure 4:
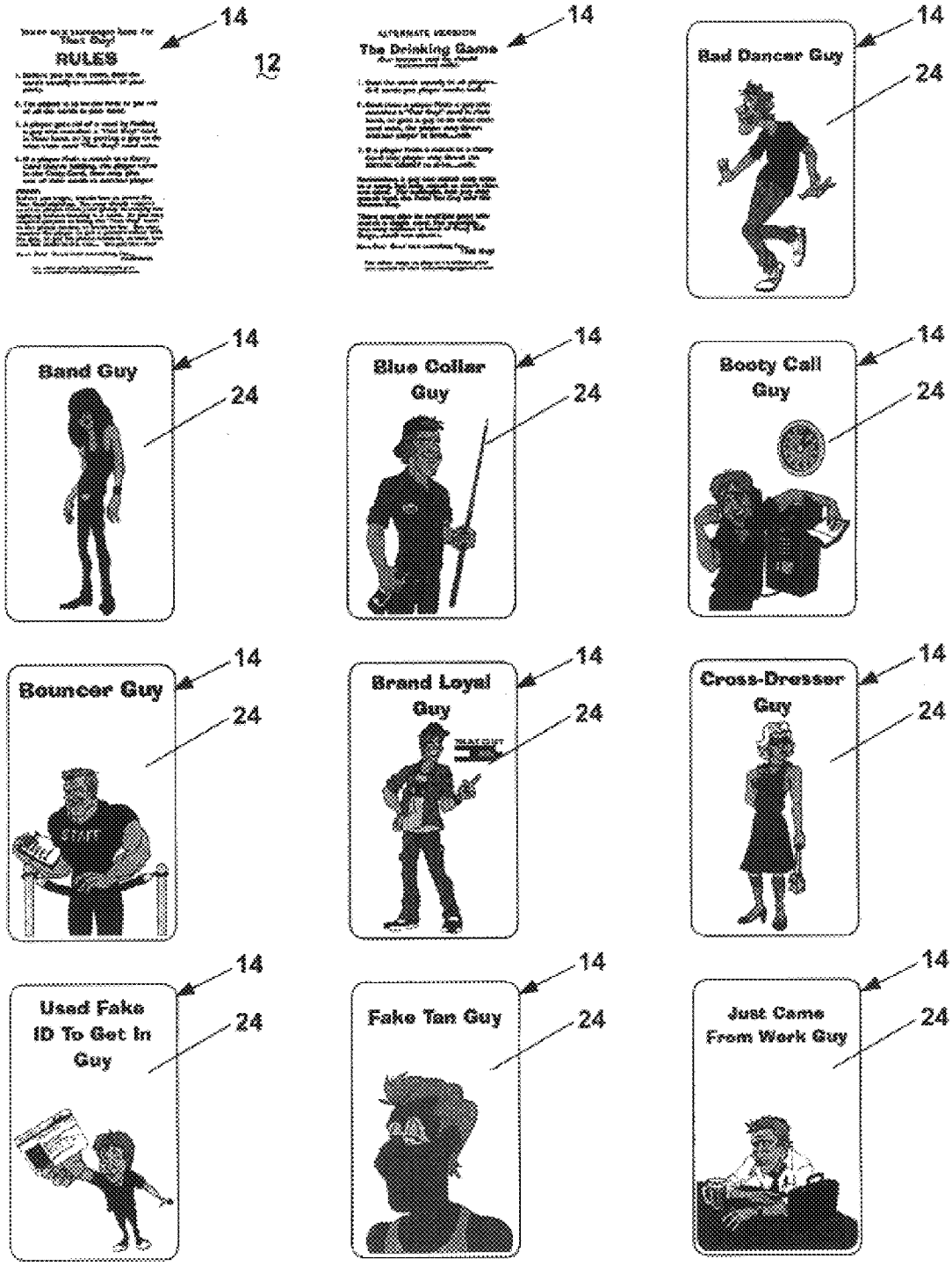
Figure 4:
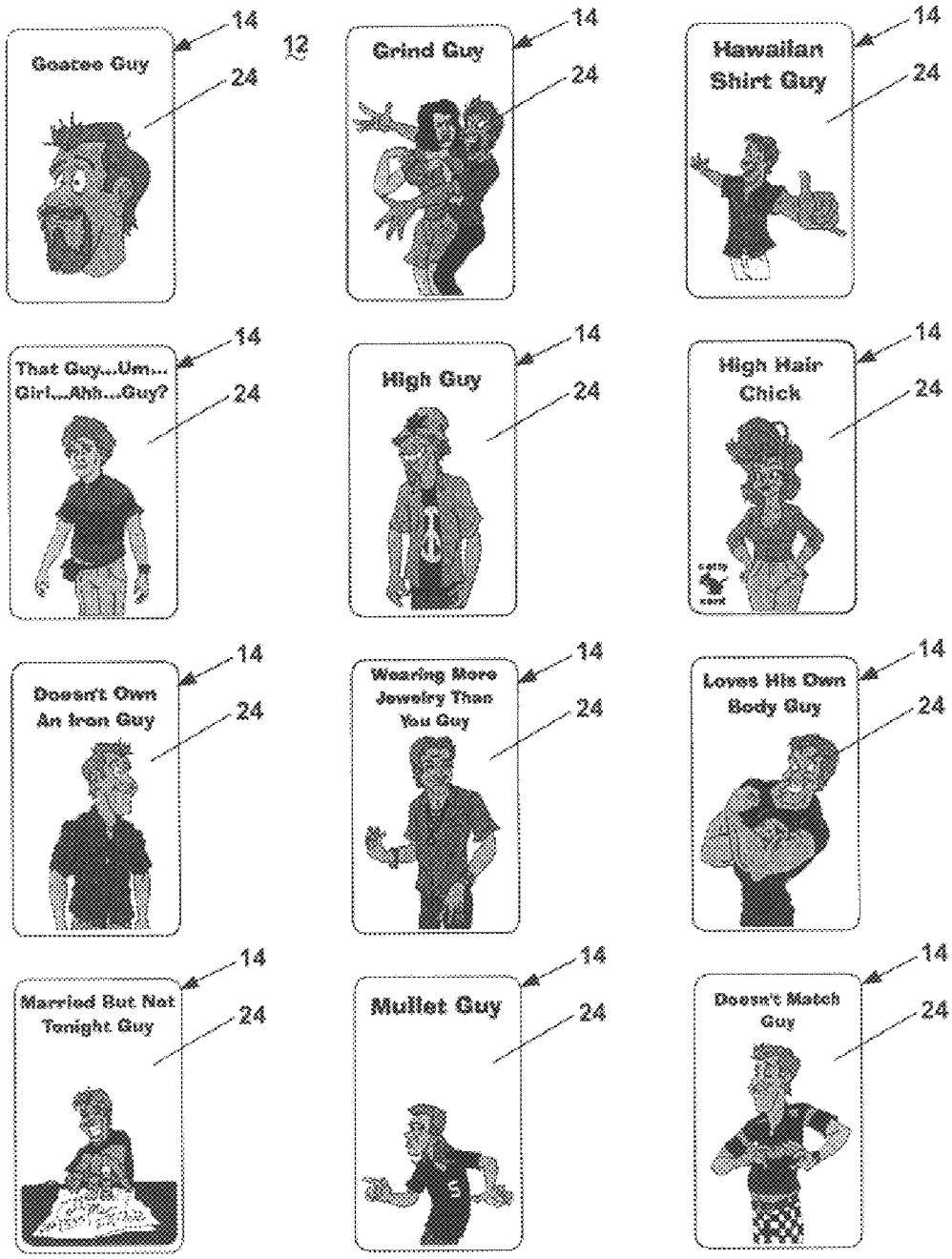
Figure 4:
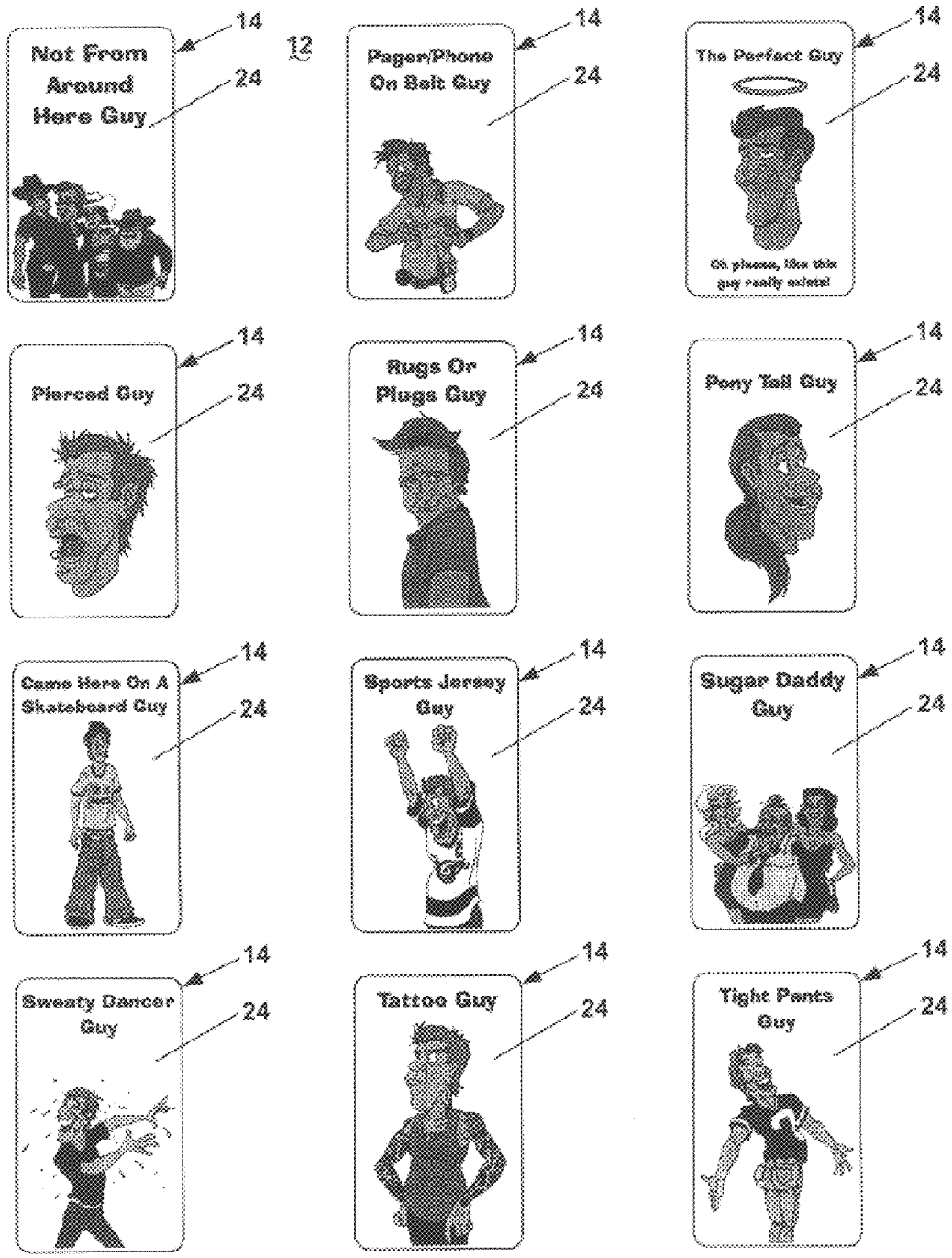
Figure 4:
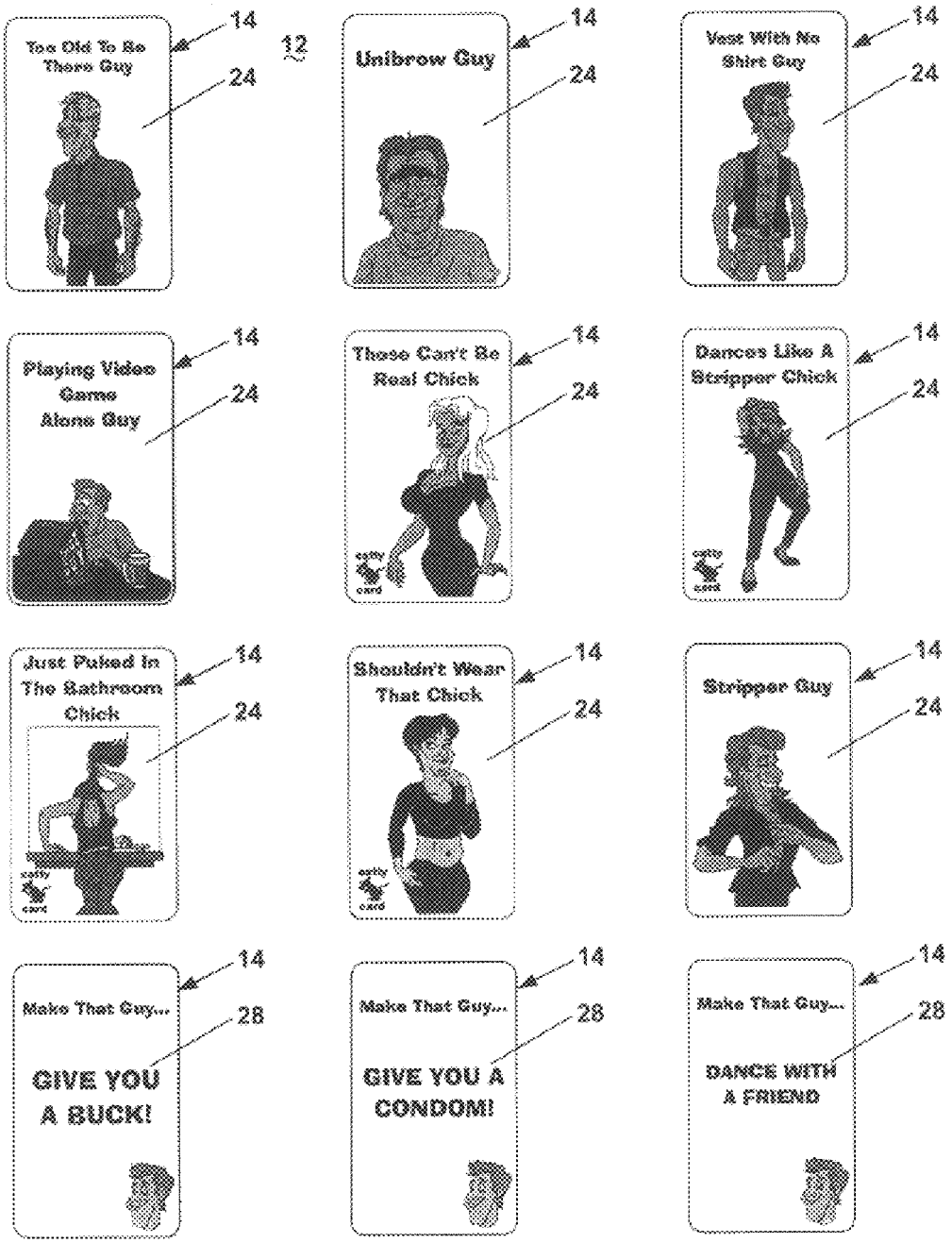
Figure 4:
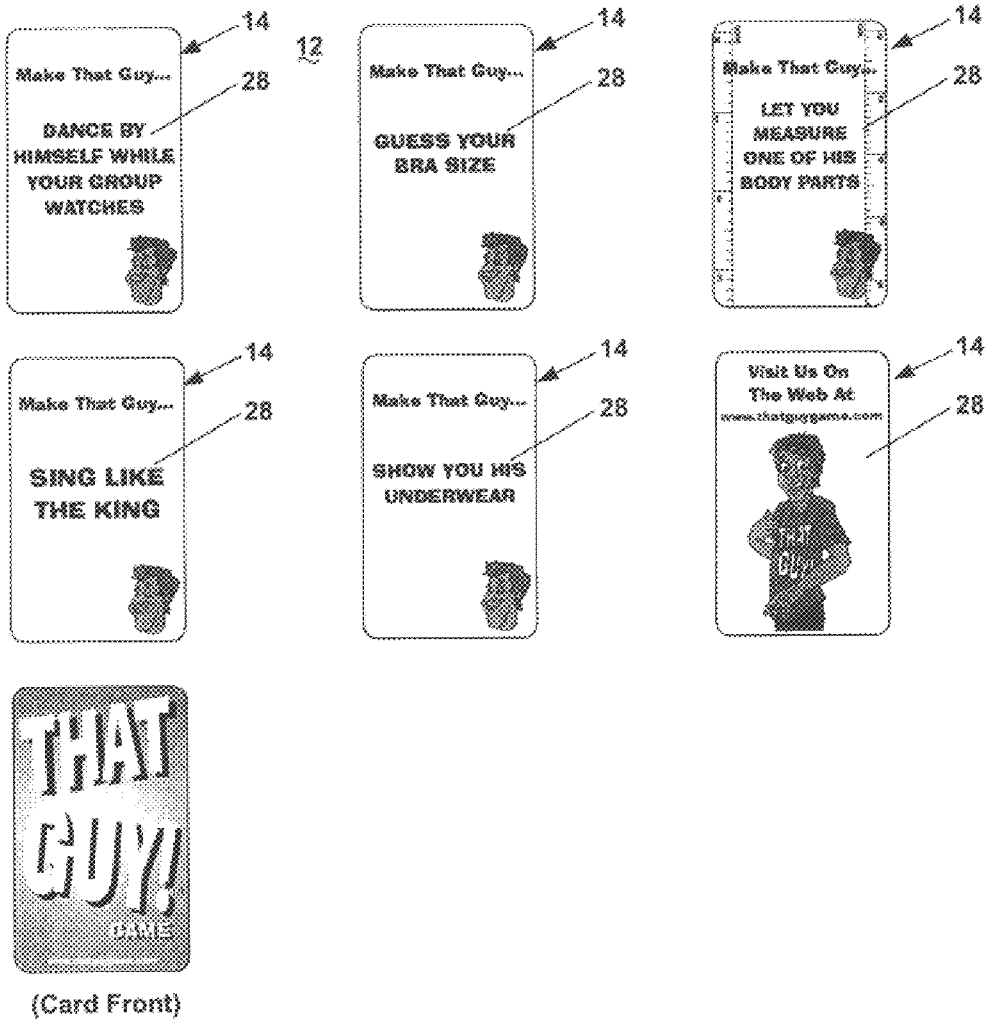

PATENT NO. : 6,609,713 B1
DATED : August 26, 2003
INVENTOR(S) : John R. Heffron and Joel C. Zimmer It is certified that error appears in the above-identified patent and that said Letters Patent is hereby corrected as shown below:

Column 3,
Line 25, please insert the following paragraph:

-- Figure 4 shows an example card deck embodying the invention of Figures 1-3 configured for use in a nightclub environment. --

Column 5,
Line 27, please insert the following paragraph:

-- Figure 4 shows an example card deck embodying the invention of Figures 1-3 configured for use in a nightclub environment. The card deck 12 shown in Figure 4 has the first and second types of cards as indicated by reference numeral 24 and 28. --

Signed and Sealed this

Thirtieth Day of December, 2003

JAMES E. ROGAN
*Director of the United States Patent and Trademark Office*